US005511838A

United States Patent [19]

Baughman et al.

[11] Patent Number: 5,511,838

[45] Date of Patent: Apr. 30, 1996

[54] REMOTE LATCH RELEASE DISABLING DEVICE

[75] Inventors: Robert W. Baughman, Mt. Clemens; Gary D. Bree, Clarkston; Lloyd W. Rogers, Jr., Shelby Township, all of Mich.

[73] Assignee: General Motors Corporation, Detroit, Mich.

[21] Appl. No.: 195,521

[22] Filed: Feb. 14, 1994

[51] Int. Cl.[6] ..... E05B 3/00; E05C 3/06

[52] U.S. Cl. ..... 892/336.3; 292/201; 292/DIG. 27

[58] Field of Search ..... 292/336.3, DIG. 27, 292/DIG. 23, DIG. 62, DIG. 65, 201; 70/256

[56] References Cited

U.S. PATENT DOCUMENTS

| | | | |
|---|---|---|---|
| 3,309,127 | 3/1967 | Pickles | 292/216 |
| 3,744,285 | 7/1973 | Barmherzig | 70/256 |
| 4,073,527 | 2/1978 | Schlage | 292/347 |
| 4,315,649 | 2/1982 | Lutz | 292/201 |
| 4,459,834 | 7/1984 | Seki | 70/256 |
| 4,492,395 | 1/1985 | Yamada | 292/216 |
| 4,508,379 | 4/1985 | Mochida | 292/336.3 |
| 4,671,087 | 6/1987 | Olenfalk | 292/DIG. 27 |
| 4,802,350 | 2/1989 | Periou | 292/201 |
| 4,837,567 | 6/1989 | Kleefeldt | 70/256 |
| 4,858,971 | 8/1989 | Haag | 292/336.3 |
| 4,929,007 | 5/1990 | Bartczak | 292/336.3 |
| 4,946,211 | 8/1990 | Gergoe | 292/DIG. 62 |
| 4,998,447 | 3/1991 | Feichtiger | 292/201 |
| 5,037,145 | 8/1991 | Wilkes | 292/336.3 |
| 5,052,731 | 10/1991 | Hayakawa et al. | 292/336.3 |
| 5,054,300 | 10/1991 | Nakahara et al. | 70/262 |
| 5,054,826 | 10/1991 | Dow | 292/DIG. 27 |
| 5,085,475 | 2/1992 | Austin | 292/336.3 |
| 5,184,490 | 2/1993 | Takahashi | 70/DIG. 30 |
| 5,228,730 | 7/1993 | Gokcebay | 292/DIG. 62 |
| 5,263,751 | 11/1993 | Priest | 292/DIG. 27 |

FOREIGN PATENT DOCUMENTS

| | | | |
|---|---|---|---|
| 2614643 | 4/1988 | France . | |
| 3802107 | 3/1989 | Germany . | |
| 4228233 | 3/1994 | Germany . | |
| 0063369 | 3/1991 | Japan | 292/DIG. 23 |

*Primary Examiner*—Steven N. Meyers
*Assistant Examiner*—Gary Estremsky
*Attorney, Agent, or Firm*—Jeffrey A. Sedlar

[57] ABSTRACT

A latch release disabling device for use in a vehicle. The device can be applied to the release mechanism of latches on passenger doors, hoods, deck lids and similar features such as latch locks. The device is useful in preventing the unlatching or unlocking of a latch by disabling the latch or lock release mechanism. The device is responsive to electrical control means and can be remotely activated.

1 Claim, 5 Drawing Sheets

REMOTE LATCH RELEASE DISABLING DEVICE

BACKGROUND OF THE INVENTION

The present invention relates to a latch operating system. More particularly, the invention is directed to a door latch operating system for a vehicle with a remotely activated disabling mechanism for preventing unwanted unlatching of the system.

It is conventional to use a mechanism to prevent unlatching of a vehicle door, generally to prevent unwanted opening of a rear door by the rear interior handle. Such mechanisms generally include a device that blocks operation of the latch. A blocking-type mechanism is subjected to loads placed upon the system when forces are applied to the handle. This requires using a mechanism with sufficient strength to prevent movement of the latch when subjected to such loads. Therefore, a relatively heavy blocking device is required in the latch mechanism to prevent movement. This typically requires a redesign of a standard latch mechanism to incorporate the device.

The latch blocking mechanism may be either manually or electrically actuated. An electrically actuated device generally includes a relatively heavy actuator to move the blocking device and hold it in position.

An electric actuator has been used in combination with the exterior key cylinder of a vehicle driver's door to provide a deadbolt locking mechanism for the door latch. A deadbolt locking mechanism is useful to prevent unlatching of a vehicle door using the handle even though the lock mechanism has been moved to an unlocked position.

A device that blocks unlatching of a door latch includes the disadvantages of requiring a redesign of the relatively complicated door latch mechanism to add an additional blocking device and actuator. This also requires a blocking device capable of withstanding forces that are exerted upon the latching system by the door handle and an actuator capable of generating a relatively high force. A device that overcomes these disadvantages and provides a simplified, inexpensive system wherein the latch assembly does not experience handle forces is preferable.

SUMMARY OF THE INVENTION

In accordance with the present invention a remotely activated latch disabling device is provided for remotely disabling an unlatch mechanism. The unlatch mechanism generally connects a latch to a release actuator such as a handle. The release actuator is used to unlatch or "release" the latch for opening a passenger door, hood, trunk or similar closure, collectively referred to as "doors"

A sensing means is preferably provided to detect operation of the release actuator. When activated by means such as closure of a remote switch, the sensing means, upon sensing movement of the release actuator toward a position that would normally unlatch the latch, signals the disabling device to disengage the unlatch mechanism to uncouple the release actuator from the latch. When the unlatch mechanism is disengaged, the handle is ineffective in causing the latch to move to an unlatch position. By disengaging the unlatch mechanism, the system significantly reduces the number of components that are subjected to forces applied to the handle.

In one particular application for which the latch disabling device is useful, the rear passenger door inside handles of a vehicle may be disabled from unlatching the rear doors. In this mode, the remote door latch disabling device provides a system for securing rear doors. This concept accomplishes the task of remotely securing the doors by disengaging the rear door unlatch mechanisms from the interior rear door handles thereby inhibiting operation of the latch to an unlatch position.

When the remote door latch disabling device is activated, movement of the interior rear door handle to what would normally be a door unlatch position fails to unlatch the rear door. Instead, when the handle is pulled, the position of the handle mechanism is detected by the sensing means that, in turn, signals the disengagement mechanism to disable the door's unlatching mechanism. By disengaging the handle mechanism from the unlatching mechanism, no forces are transmitted to the door's latch and the door cannot be opened by using the interior handle.

The remote door latch disabling device can also be used in this and other configuration's in a deadbolt locking mode. In this mode the disabling device is activated by the driver's door key cylinder or other remote means. Preferably, the key cylinder is equipped with a monitoring device that senses the rotation of the key cylinder into a deadbolt activation position. Once activated into the deadbolt mode, movement of the door handle triggers the sensing means to signal the disengagement mechanism to disable the unlatching mechanism. This action will prevent opening of the door using the handle until the deadbolt is removed by disengaging the disabling device using the key cylinder. Therefore, when the deadbolt is activated, the latch release mechanism will be disabled and the handle will not open the door.

The invention provides a simplified system to prevent the movement of a release actuator from unlatching a latch. The device is usable as part of a central locking system to provide increased security to the various components of a vehicle's body that can be opened and are held closed by latches. An aspect of the invention that facilitates such use is the electrically controlled operation that imparts no quiescent current drain even when the system is activated. The design facilitates the use of an electric actuator with a relatively low force output.

DETAILED DESCRIPTION OF THE PRESENTLY PREFERRED EMBODIMENT

Figure 1:
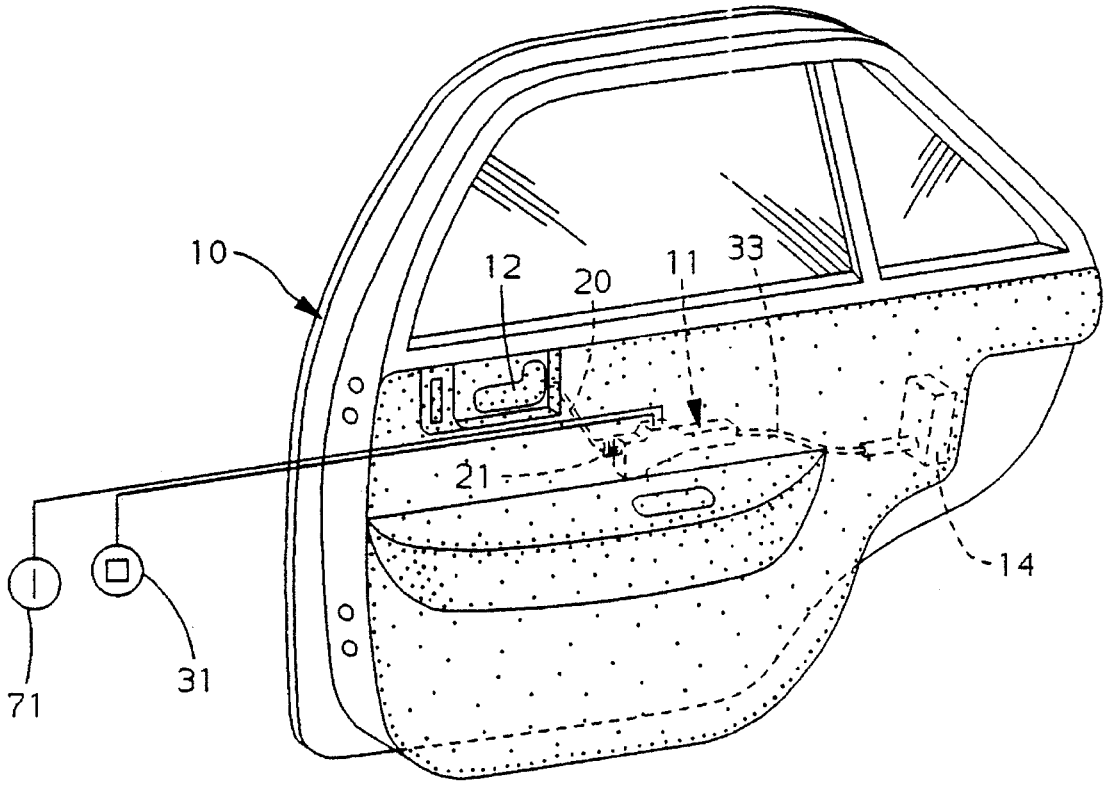
FIG. 1 is a schematic view of a door with a latch operating system according to the invention.

Referring to FIG. 1, a vehicle passenger door is illustrated showing components of a latch operating system incorporating elements of the present invention. The door, designated as 10, is adapted for installation in a door opening of a vehicle (not shown). The remotely activated door latch disabling device 11 is mounted in a location within the door 10 convenient for peripheral attachments to an inside latch release handle 12 and the door latch 14.

A handle lever 21 and handle link 20 are provided between the handle 12 and the disabling device 11. The handle lever 21 is guided for rectilinear movement to mechanically translate actuation of the door handle 12 and the handle link 20 to the disabling device 11. The handle 12 is movable between a normally released position corresponding to a door latched condition and an unlatch position corresponding to an unlatched condition of the latch 14.

Connected between the disabling device 11 at unlatch lever 27 (shown in FIG. 2) and the door latch 14 is a mechanism 33 to translate mechanical movement from the disabling device 11 to the latch 14 for selectively unlatching the door latch 14. The translation mechanism designated as 33 provides a mechanical link generally in the form of a rod or a cable. These mechanical elements provide the means whereby handle 12 can be selectively used to release the door latch 14 through the interconnected handle link 20, handle lever 21, disabling device 11, unlatch lever 27 and translation mechanism 33. Disabling device 11 provides the means to selectively prevent handle 12 from releasing door latch 14. In the illustrated embodiment, translation mechanism 33 is shown as a cable.

Remote control switch 31 is provided in a location remote from disabling device 11 and convenient to a vehicle's operator. The switch 31 is coupled to a normally open position switch 32 (shown in FIG. 2) mounted on disabling device 11. Position switch 32 is also electrically coupled (through means not illustrated) to relay 25. The switches 31 and 32 and the relay 25 are electrically series coupled across the vehicle battery (not shown) so that the relay is energized when both of the switches 31 and 32 are closed.

Figure 2:
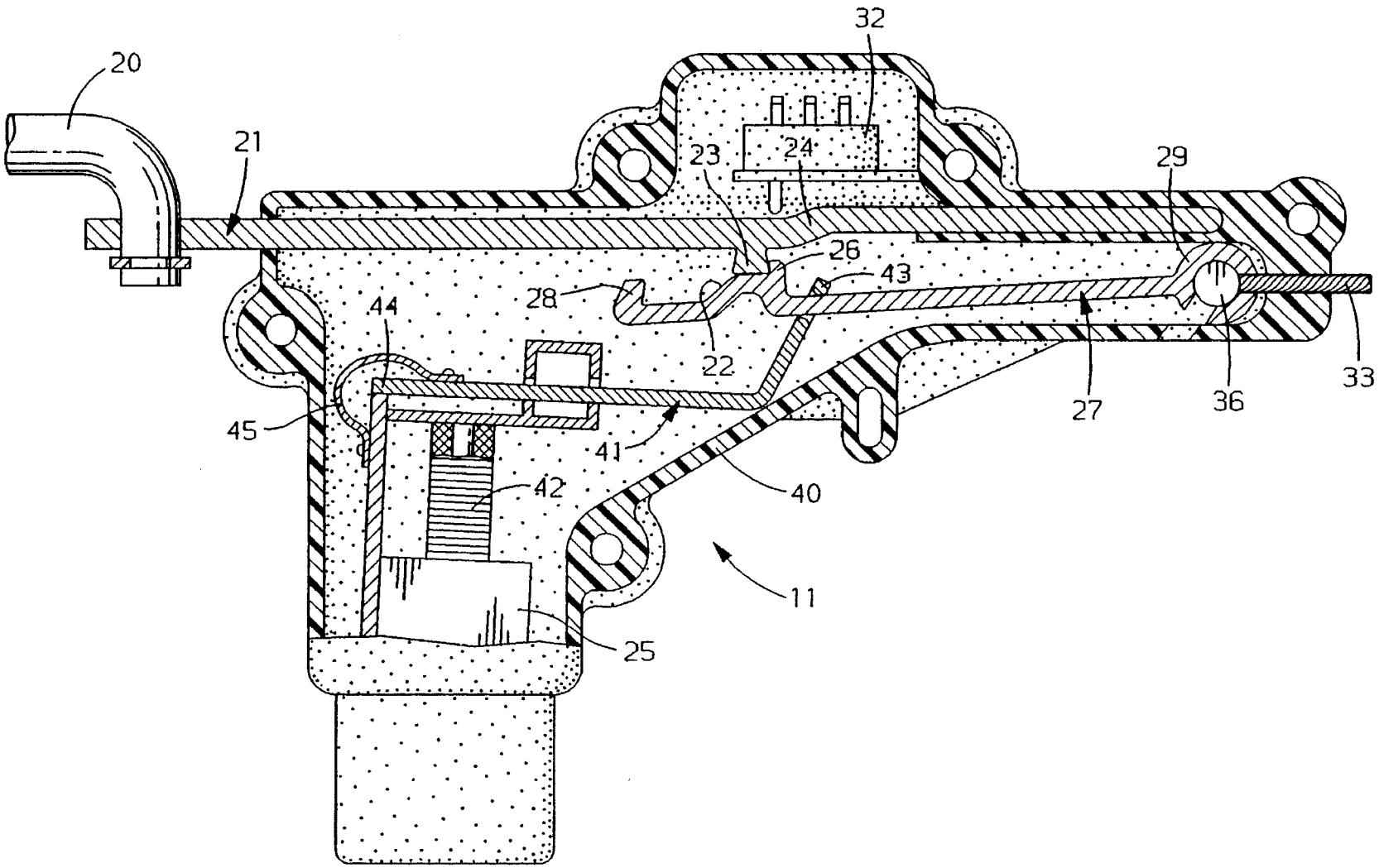
FIG. 2 is an illustration of a door latch disabling device shown in the normal position.

Referring to FIG. 2, a more detailed illustration of the disabling device assembly 11 is shown. Housing 40 provides a base upon which the other components of the disabling device are mounted, creating a modular assembly that is easily installed in a vehicle. The basic form of housing 40 is shown for use in a passenger door latch operating system, although the housing will be designed to fit within the confines that are associated with a particular application in which the disabling device is used. Housing 40 is comprised of a molded, polymeric material, although alternative materials of acceptable structural integrity could also readily be used to provide a sufficient housing for the disabling device 11.

Handle lever 21 is guided to move rectilinearly within housing 40 and extends from the housing 40 for attachment to a handle link 20 of an interior door handle 12 (shown in FIG. 1). In an application with a cable handle link mechanism, handle lever 21 would be provided with a means either inside or outside the housing 40 for attachment to the cable. Alternative mechanical linking devices could also be used between the handle 12 and handle lever 21 and would likewise be provided with an appropriate attachment mechanism to lever 21. In the illustrated embodiment handle lever 21 extends toward handle 12 and is connected to handle link 20.

Leg 23 extends from handle lever 21 and provides a convenient surface for selectively coupling to a mechanism to provide an output for the disabling device assembly 11. Handle lever 21 also includes offset 24. Offset 24 is conveniently located along handle lever 21 for communication with position switch 32. Position switch 32 senses the location of offset 24. By so doing, position switch 32 determines the location of handle 12, discerning whether handle 12 is at a normal released position or an unlatch position.

Figure 3:
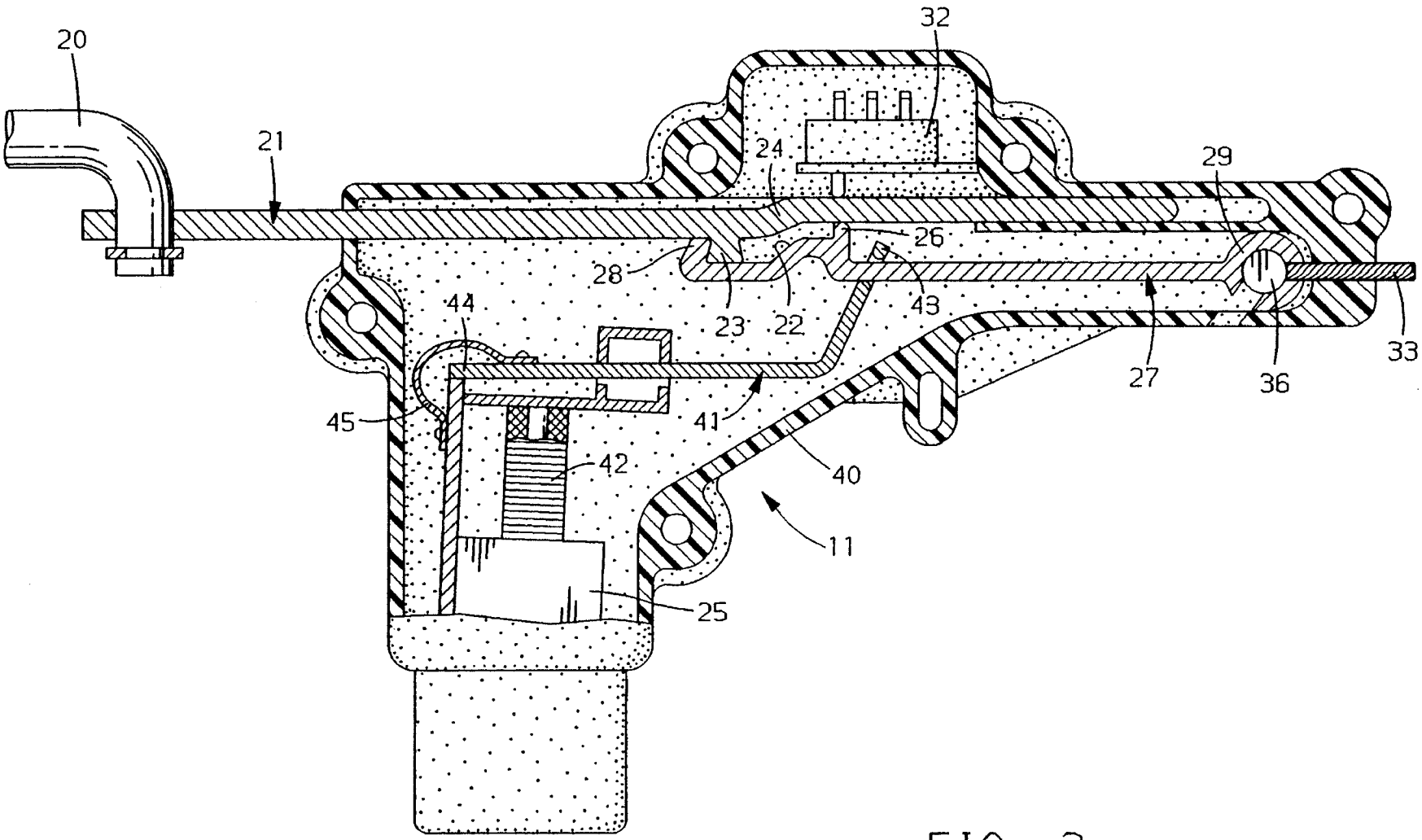
FIG. 3 is an illustration of the door latch disabling device shown in an engaged condition.

Cooperating with handle lever 21 is unlatching lever 27. Unlatching lever 27 includes finger 28 that is shaped to engage leg 23 of handle lever 21 to provide the normal coupling of the handle 12 to the latch 14. Finger 28 is shown in FIG. 3 engaging leg 23. At the opposite end of unlatching lever 27 from finger 28 is output connector 29. Output connector 29 is provided for connection to translation device 33, for transmitting mechanical movement. A ball 36 is attached to translation device 33 for connection to the output connector 29 of unlatching lever 27. Unlatching lever 27 is mounted to pivot about the output connector 29 end and also for rectilinear movement in coordination with handle lever 21.

Unlatching lever 27 includes cam surface 22. Cam surface 22 cooperates with leg 23 of handle lever 21 to position unlatching lever 27 in a normal position as shown in FIG. 2. When handle 12 is in a released position, handle lever 21 is in a normal position corresponding to a latched position of latch 14 as shown in FIG. 2. With handle lever 21 in the normal position, leg 23 meets cam surface 22 adjacent to finger 26 causing unlatching lever 27 to be pivoted about the output connector 29 end into the normal position that substantially corresponds with the position of unlatching lever 27 in a disengaged condition.

Bypass lever 41 in combination with coil assembly 42 provides a mechanism for selectively maintaining the normal position of unlatching lever 27. In this embodiment, bypass lever 41 is comprised of a ferromagnetic material. Bypass lever 41 is mounted in proximity to coil assembly 42 and is moveable through a limited degree of rotation about pivot point 44. Bypass lever 41 is biased toward an upward position by spring 45 for urging unlatching lever 27 into an engaged condition with handle lever 21. Bypass lever 41 includes finger 43 providing an engagement mechanism between the bypass lever 41 and unlatching lever 27.

Figure 5:
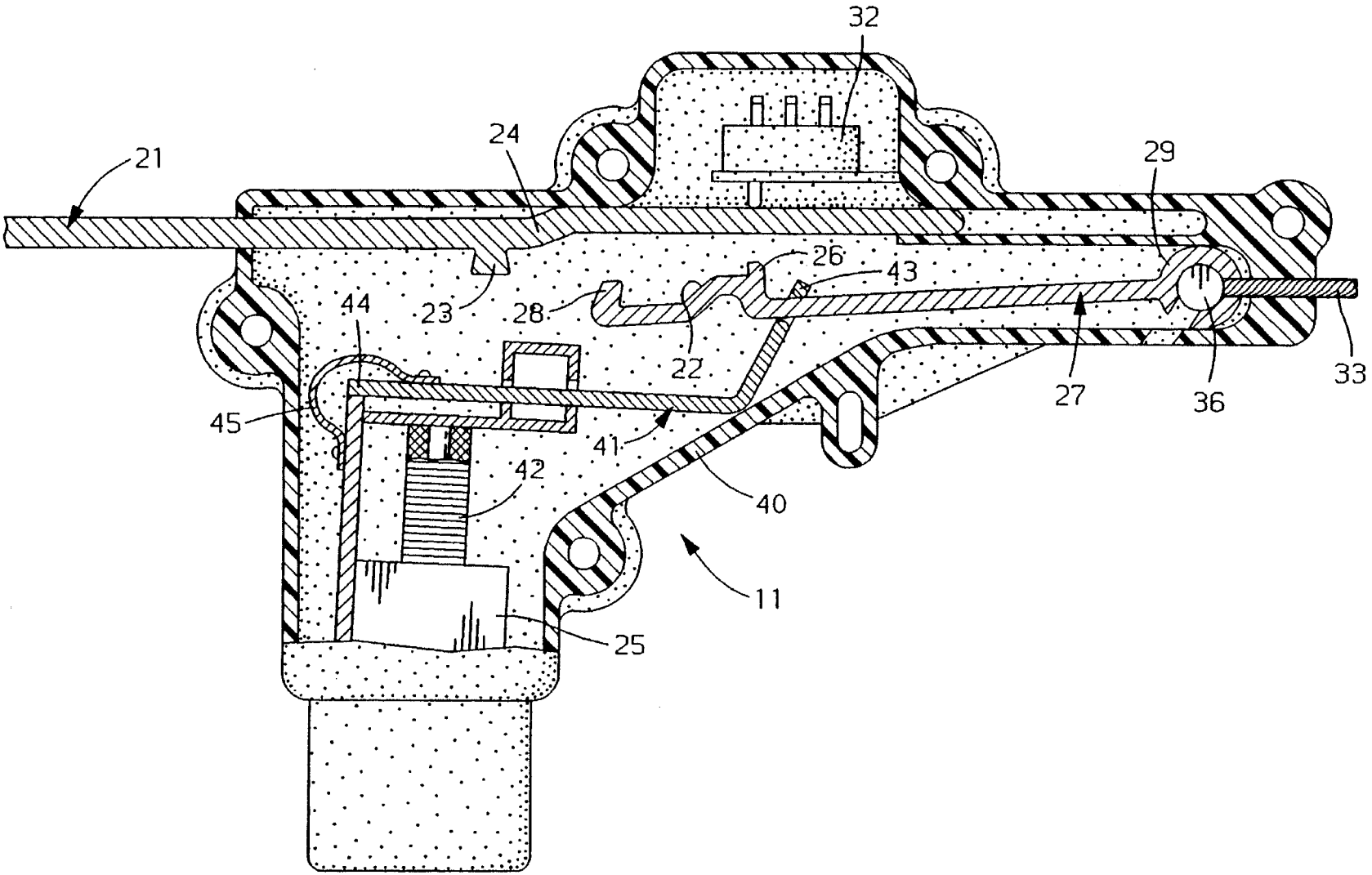
FIG. 5 is an illustration of the door latch disabling device disengaged and shown moved to an unlatch position.

Coil assembly 42, when energized, induces an electromagnetic force that acts upon bypass lever 41 causing it to overcome the bias force of spring 45 and rotate about pivot point 44, whereby finger 43 draws or holds unlatching lever 27, placing it in a disengaged condition as shown in FIG. 5. The position of unlatching lever 27 while in a disengaged condition as shown in FIG. 5, substantially corresponds to the normal position as shown in FIG. 2.

The purpose of bypass lever 41 is to selectively maintain unlatching lever 27 in a disengaged condition from handle lever 21. When the normal position of unlatching lever 27 is maintained, movement of handle lever 21 results in a disengaged condition as leg 23 looses contact with cam surface 22. While in a disengaged condition, forces applied to handle 12 are only transferred through the latch operating system as far as handle lever 21. This provides the benefit that latch mechanism components downstream from handle lever 21 are not subjected to forces applied to the handle. Therefore, they do not have to be designed to withstand such forces and regardless of the amount of force applied to handle 12, latch 14 is not unlatched.

Bypass lever 41 can be reconfigured as a link between handle lever 21 and unlatch lever 27 or integrated into the unlatching lever 27. The critical aspect is the ability of bypass lever 41 to disengage handle lever 21 from unlatching lever 27 to uncouple handle 12 from the door latch 14. The resulting flexibility in design of bypass lever 41, allows the device to be condensed into a smaller package for use in locations with available space more limited than that of a vehicle passenger door.

Disabling device assembly 11 can be used to selectively uncouple handle 12 from unlatching latch 14 by disengaging unlatching lever 27 from handle lever 21. In operation, remote actuation switch 31 is positioned to activate the control scheme and energize position switch 32. When energized, position switch 32 stands ready to respond to movement of handle lever 21 and activate the disengaging mechanism. When in this mode, there is no quiescent current drain caused by position switch 32.

If handle 12 is moved toward an unlatch position, a corresponding movement of handle link 20 and handle lever 21 results. When energized, position switch 32 senses movement of offset 24 of handle lever 21, in-that, the switch is closed by offset 24. Position switch 32 is located such that a relatively small initial movement of handle 12 will effect a response from the switch to actuate coil 42 before leg 23 engages finger 28.

Other types of devices responsive to mechanical movement could effectively be used in place of switch 32 to respond to system movement. When remote control switch 31 is positioned to activate the disabling device, closure of switch 32 signals relay 25 to close and energize coil assembly 42. When energized, coil assembly 42 induces a magnetic force that acts upon bypass lever 41 drawing it to place and hold unlatching lever 27 in a disengaged condition from handle lever 21.

Also readily applicable to apply force to bypass lever 41 would be a solenoid having an armature mounted to the bypass lever or an equivalent device. A feature of the invention however, is that the electromagnetic coil 42 and bypass lever 27 of relatively low ability to induce force is sufficient. Because the unlatching lever 27 is moved to the normal position by leg 23 of handle lever 21 as shown in FIG. 2, the bypass lever 41 will generally only be required to maintain that position rather than effect a rapid relocation of unlatching lever 27. Therefore, the invention eliminates the need for an actuator that can develop high forces. Additionally, a rapid jerk on the handle 12 is ineffective in beating the disengagement mechanism and unlatching the door when the system is activated because of the substantial correspondence between the normal position as shown in FIG. 2 and the disengaged condition position as shown in FIG. 5 in combination with the rectilinear movement required to engage leg 23 with finger 28.

FIG. 5 illustrates the disabling device mechanism in a disengaged condition. In this condition, handle 12 is ineffective in releasing latch 14. It can readily be seen that with unlatching lever 27 held in the normal position by bypass lever 41, rectilinear movement of handle lever 21 will be ineffective in translating motion to unlatching lever 27, since finger 28 is held out of the path of leg 23. A feature of the present invention resides in the fact that force applied upon handle lever 21 by handle 12, when unlatching lever 27 is in a disengaged condition, is not transmitted to latch 14. Therefore, latch 14 does not need to be able to withstand such forces or be provided with a mechanism to prevent release when forces are applied to handle 12.

When the remote control switch 31 is positioned to deactivate disabling device 11, handle 12 is again effective in unlatching latch 14. As handle 12 is moved to an unlatch position, handle lever 21 moves rectilinearly in response. As leg 23 moves toward finger 28, cam surface 22 remains in contact with leg 23 since bypass lever 41 no longer holds unlatching lever 27 in the normal position. Accordingly, upon further movement of handle lever 21, cam surface 22 remains in contact with leg 23 and leg 23 will engage finger 28 as shown in FIG. 3. This effectively couples handle 12 to the door latch 14 and the latch operating mechanism is functional to release the latch.

Because disabling device 11 is designed to respond to switch 31, the device is readily adaptable to respond to remote control signals of various types. This feature also makes the device readily adaptable to use as part of a central locking system that is electronically controlled.

Figure 4:
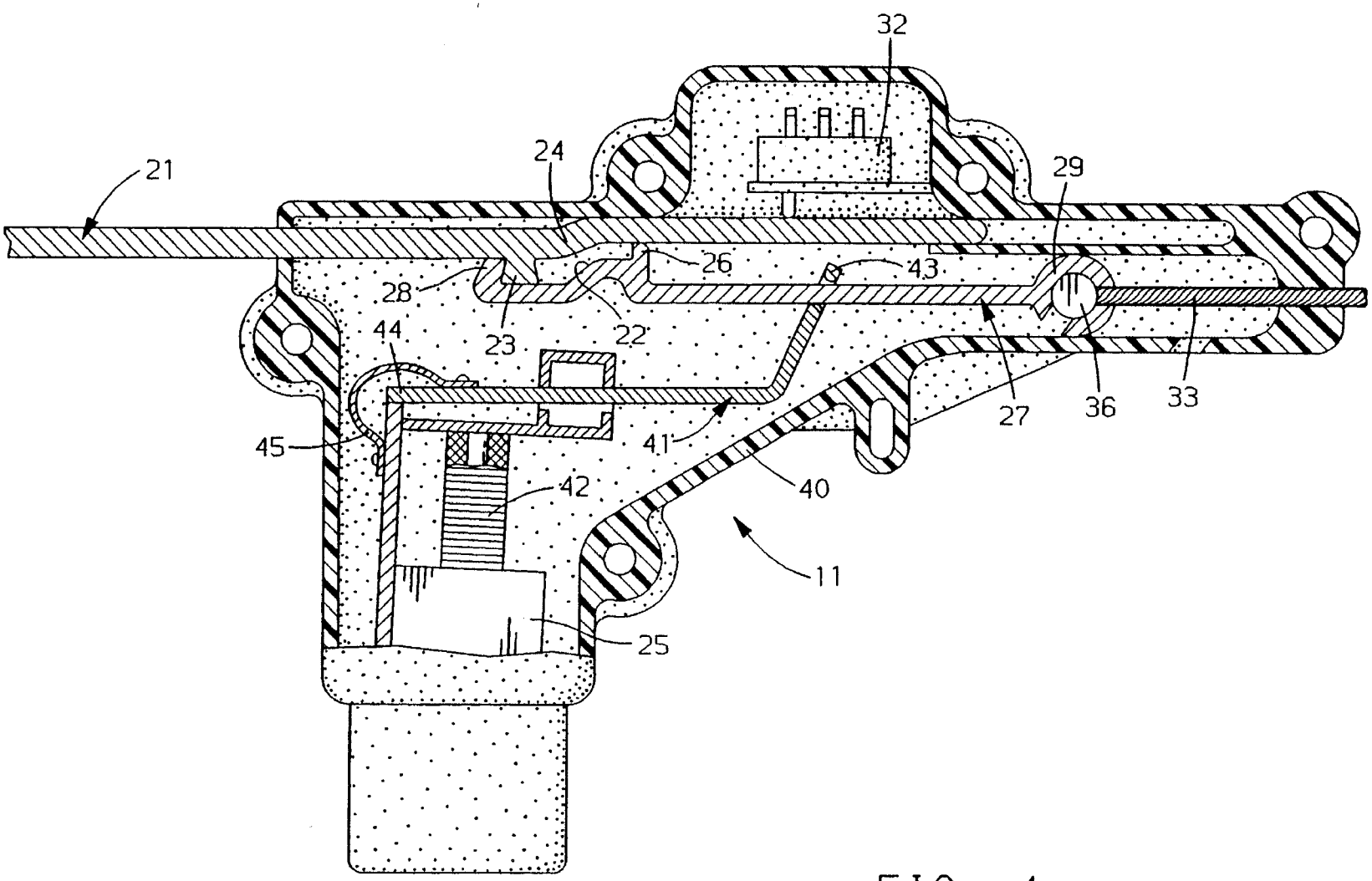
FIG. 4 is an illustration of the door latch disabling device of FIG. 3 engaged, and shown moved to an unlatch position

FIGS. 4 and 5 more clearly illustrate the operation of the disabling device assembly 11. In FIG. 4, as in FIG. 3, the system is in an engaged condition. FIG. 4 shows the position established when the engaged device is moved to an unlatch position. Leg 23 coordinatedly moves finger 28 and therefore, unlatching lever 27 to the unlatch position. This results in movement of translation mechanism 33 and release of latch 14 (if in an unlocked condition) and permits opening of door 10.

FIG. 2 shows not only the normal position of unlatching lever 27 established by the co-action of leg 23 with cam surface 22 but also the corresponding position established when coil 42 is energized and the system is in a disengaged condition. FIG. 5 illustrates the result when the disengaged device is moved to the unlatch position. Leg 23 moves past finger 28 and therefore, unlatching lever 27 does not move from the latched position. This results in latch 14 remaining latched regardless of the locked or unlocked condition of the latch 14.

Although the use of disabling device 11 has been described primarily in application for a passenger door latching system, alternative uses can be found in many other latch operating systems within an automobile. The device is readily applicable in a total vehicle security system to disable any mechanism that is released by a cable or rod or similar translation device. The disabling device is readily applicable in remotely disabling the rear door inside handles of a vehicle to prevent the doors from being unlatched. The interior handle of the rear door may be remotely disabled by electrically engaging the system using a switch conveniently located to the vehicle's driver.

The disabling device according to the present invention is also readily applicable in deadbolt locking or unlatching of vehicle systems. To improve security and safety it is desirable to provide a mode beyond typical locking of a door to prevent unwanted openings from occurring. Deadbolt locking provides a mechanism to prevent the opening of any vehicle door manually by using the handle.

When a disabling device according to the present invention is installed in a door latch system, the handle is incapable of unlatching the door when the system is activated. It may also be preferable to include a similarly configured device to disable the door's lock release mechanism. This will prevent unlocking the door by repositioning the lock release through movement of the lock handle.

The deadbolt system is engaged and disengaged from outside the vehicle through the key cylinder 71, as illustrated in FIG. 1. To activate a deadbolt system the key cylinder is rotated a specified number of degrees from vertical to horizontal. The key is then removed. At this point, the deadbolt system is activated.

For clarity, the deadbolt function will be described in relation to an interior handle of a passenger door latch operating mechanism, although it is readily applicable to other latch and lock mechanisms. For this description, reference is directed to FIG. 5.

When the deadbolt system is activated, movement of the interior door handle 12 causes handle lever 21 to move. Position switch 32 senses movement of handle lever 21 and signals relay 25 to energize coil 42, causing bypass lever 41 to impose a disengaged condition upon unlatching lever 27. At this point, movement of handle 12 is ineffective in releasing latch 11.

The deadbolt system is disengaged through the key cylinder 71 by inserting the key and rotating from horizontal a specified number of degrees to an unlocked position and rotating the key back to vertical. The key is then removed and the vehicle is undeadbolted and unlocked. The system is readily applicable to alternative types of remote actuation.

The latch disabling device of the present invention has been described primarily in application on a passenger door latch operating mechanism. It will be appreciated by one skilled in the art that the operating principles could readily be applied to other vehicle systems using latches and latch release mechanisms.

We claim:

1. A remote latch release disabling device comprising:

a housing;

a handle lever guided by the housing for rectilinear movement therethrough and having a leg extending from the handle lever;

an unlatching lever pivotably carried by the housing including a cam surface normally engaging the leg, a first finger engageable with the leg and a second finger engageable with the leg;

a pivotable by-pass lever engaging the unlatching lever;

a spring engaging the by-pass lever to normally bias the cam surface of the unlatching lever against the leg of the handle lever;

a solenoid capable of preventing the by-pass lever from biasing the cam surface of the unlatching lever against the leg of the handle lever when energized; and a switch operated by the handle lever capable of initiating energization of the solenoid.

* * * * *